US009468292B2

(12) United States Patent
Kuehn

(10) Patent No.: US 9,468,292 B2
(45) Date of Patent: Oct. 18, 2016

(54) SHELVING CONNECTOR AND ASSOCIATED STORAGE SYSTEM AND METHOD

(71) Applicant: TARGET BRANDS, INC., Minneapolis, MN (US)

(72) Inventor: Thomas P. Kuehn, St. Louis Park, MN (US)

(73) Assignee: Target Brands, Inc., Minneapolis, MN (US)

( * ) Notice: Subject to any disclaimer, the term of this patent is extended or adjusted under 35 U.S.C. 154(b) by 44 days.

(21) Appl. No.: 14/642,200

(22) Filed: Mar. 9, 2015

(65) Prior Publication Data

US 2016/0262536 A1 Sep. 15, 2016

(51) Int. Cl.
*A47B 57/34* (2006.01)
*A47B 96/06* (2006.01)

(52) U.S. Cl.
CPC ..... *A47B 57/34* (2013.01); *A47B 96/061* (2013.01)

(58) Field of Classification Search
CPC .... A47B 57/20; A47B 57/34; A47B 57/545; A47B 57/562; A47B 96/061; F16B 7/048
USPC ..... 211/187
See application file for complete search history.

(56) References Cited

U.S. PATENT DOCUMENTS

| | | | | |
|---|---|---|---|---|
| D29,051 | S | 7/1898 | Lake et al. | |
| 1,172,355 | A | 2/1916 | Guest | |
| 3,144,232 | A | 8/1964 | Smootz | |
| 3,521,579 | A | 7/1970 | Stafford | |
| D219,573 | S | 12/1970 | Weiss | |
| 3,696,763 | A | 10/1972 | Evans | |
| D240,710 | S | 7/1976 | Shaneour | |
| 3,977,528 | A | 8/1976 | Berger | |
| 4,277,040 | A | 7/1981 | Christoffel, Jr. | |
| 4,301,985 | A | 11/1981 | Ballard | |
| 4,582,001 | A | 4/1986 | Leikarts | |
| 4,687,167 | A * | 8/1987 | Skalka | A47B 21/0314 108/103 |
| 4,712,757 | A | 12/1987 | Ahmann | |
| 4,750,626 | A | 6/1988 | Nicely | |
| 4,799,818 | A | 1/1989 | Sudimak et al. | |
| D314,548 | S | 2/1991 | Whitley, II | |
| 5,035,186 | A | 7/1991 | Uredat et al. | |
| D321,765 | S | 11/1991 | Morse | |
| 5,127,342 | A | 7/1992 | Taylor | |

(Continued)

OTHER PUBLICATIONS

Target Tier Wide Storage Shelving, Admitted Prior Art, 2012 (3 pages).

(Continued)

*Primary Examiner* — Korie H Chan
(74) *Attorney, Agent, or Firm* — JoAnn M. Seaton; Griffiths & Seaton PLLC

(57) ABSTRACT

A shelving connector for coupling an auxiliary shelf within a shelving system includes a coupling sleeve, a support rod, and a bridge member. The coupling sleeve defines and extends between a first sleeve end and a second sleeve end and defines a sleeve exterior surface and a sleeve interior cavity. The sleeve interior cavity is open at each of the first sleeve end and the second sleeve end. The support rod defines a rod exterior surface. The center axis of the coupling sleeve and a center axis of the support rod are positioned to extend substantially parallel to each other. The bridge member is secured to the sleeve exterior surface and the rod exterior surface to statically hold the support rod in a position laterally spaced from and vertically offset from the coupling sleeve.

17 Claims, 12 Drawing Sheets

(56) References Cited

U.S. PATENT DOCUMENTS

| | | | | |
|---|---|---|---|---|
| 5,218,914 | A | 6/1993 | Dickinson | |
| 5,269,488 | A | 12/1993 | Lach | |
| 5,644,993 | A * | 7/1997 | Dohnalik | A47B 21/02 108/108 |
| 5,695,081 | A | 12/1997 | Alkalay | |
| 5,884,567 | A * | 3/1999 | Bartz, Jr. | A47B 57/04 108/106 |
| 5,906,284 | A * | 5/1999 | Hammerstrom | B25H 1/02 211/107 |
| 5,924,581 | A | 7/1999 | Chen | |
| 6,044,988 | A | 4/2000 | Yang | |
| 6,068,143 | A | 5/2000 | Wang | |
| 6,082,070 | A | 7/2000 | Jen | |
| 6,179,260 | B1 * | 1/2001 | Ohanian | A61G 7/05 248/219.4 |
| 6,253,933 | B1 * | 7/2001 | Yang | A47B 57/545 108/147.12 |
| 6,257,426 | B1 | 7/2001 | Masunaka et al. | |
| 6,302,284 | B1 | 10/2001 | Zonshin | |
| 6,364,139 | B1 | 4/2002 | Chen | |
| 7,407,060 | B2 | 8/2008 | Swartz et al. | |
| 7,478,971 | B2 * | 1/2009 | Li | A47B 57/545 108/147.13 |
| D602,771 | S | 10/2009 | VanElverdinghe | |
| D606,389 | S | 12/2009 | Werschmidt | |
| D626,405 | S | 11/2010 | Goad | |
| 7,832,571 | B2 * | 11/2010 | Felsenthal | A47B 47/027 211/134 |
| D629,285 | S | 12/2010 | Gharst | |
| D636,658 | S | 4/2011 | McGrath | |
| 8,056,740 | B2 | 11/2011 | Weshler et al. | |
| 8,074,583 | B2 | 12/2011 | Lee | |
| D654,353 | S | 2/2012 | Tabler | |
| D658,045 | S | 4/2012 | Tabler | |
| 8,616,138 | B1 | 12/2013 | Fu | |
| 8,640,893 | B2 * | 2/2014 | Kessell | A47B 57/26 211/187 |
| 8,678,207 | B2 * | 3/2014 | Shimazaki | A47B 57/545 108/147.13 |
| 8,887,647 | B2 * | 11/2014 | Sabounjian | A47B 57/10 108/147.13 |
| 2002/0148936 | A1 * | 10/2002 | Oddsen, Jr. | F16M 11/04 248/274.1 |
| 2003/0122052 | A1 | 7/2003 | Huang et al. | |
| 2006/0202091 | A1 | 9/2006 | Oddsen, Jr. et al. | |
| 2007/0187559 | A1 * | 8/2007 | Newkirk | A61G 12/005 248/125.8 |
| 2014/0261107 | A1 | 9/2014 | Sabounjian | |

OTHER PUBLICATIONS

U.S. Appl. No. 29/519,832, filed Mar. 9, 2015 (8 pages).

"Metro® Commercial Shelf Connectors", printed from www.containerstore.com/shop/?productId=10025284, publicly available at least as early as Sep. 21, 2010 (4 pages).

"Spg International PC2 Silver Post Connector", printed from www.peachsuite.com/aco-pc2/spg-international-pc2-silver-p...019-sku%5EACO@ADL4PC2-adType%5EPLA-device%5Ec-adid%5E46123248419, publicly available at least as early as Oct. 15, 2014 (2 pages).

"Tube Connector for Wire Shelving Posts", printed from www.grand-benedicts.com/retail-shelving-systems/retail-shelving-systems-tube-connector.asp?gclid=CKuP6vHMr8ECFYU9aQodIUYA9g, available 2013 (1 page).

* cited by examiner

SHELVING CONNECTOR AND ASSOCIATED STORAGE SYSTEM AND METHOD

BACKGROUND OF THE INVENTION

Storage racks or shelving units are common in homes, offices, garages, pantries, and many other areas. To increase the functionality of such storage racks, it is often desirable to have flexibility in positioning shelves or even entire shelving units relative to each other, etc. while still providing a structurally sound unit or assembly of units. When shelving units are assembled in a side-by-side or end-to-end relationship, vertical support portions of the shelving units are often duplicated and placed to abut one another. To increase stability, the duplicate support portions may be coupled to one another.

SUMMARY OF THE INVENTION

One aspect of the present invention relates to a shelving connector for coupling an auxiliary shelf within a shelving system. The shelving connector includes a coupling sleeve, a support rod, and a bridge member. The coupling sleeve defines and extends between a first sleeve end and a second sleeve end and defines a sleeve exterior surface and a sleeve interior cavity. The sleeve interior cavity is open at each of the first sleeve end and the second sleeve end. The support rod defines a rod exterior surface. The center axis of the coupling sleeve and a center axis of the support rod are positioned to extend substantially parallel to each other. The bridge member is secured to the sleeve exterior surface and the rod exterior surface to statically hold the support rod in a position laterally spaced from and vertically offset from the coupling sleeve. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Figure 1:
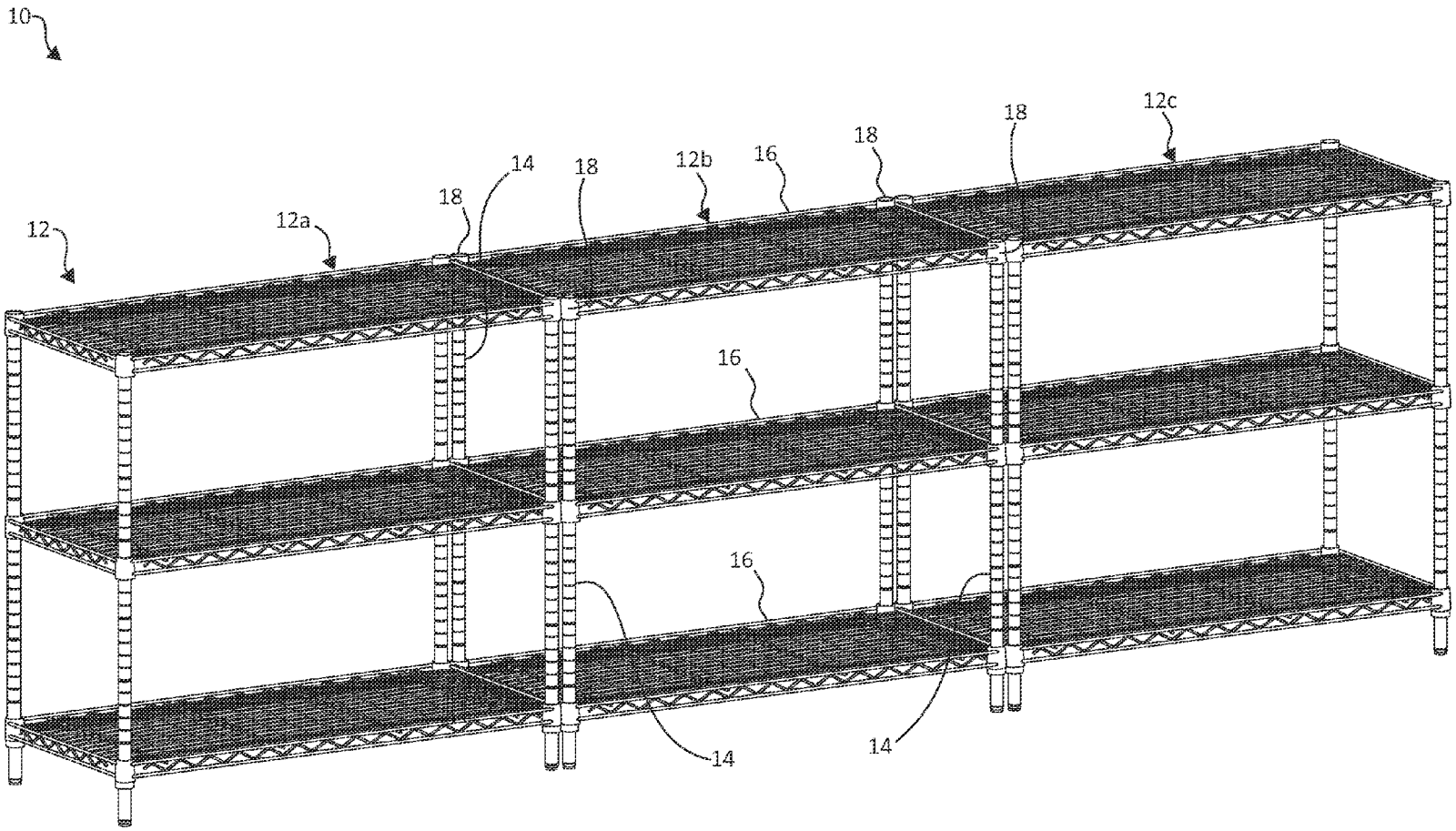
FIG. 1 (PRIOR ART)
FIG. 1 is a front isometric view illustration of a prior art shelving system.

Use of a plurality of shelving connectors according to the present invention provides for support of at least one additional shelf between two elongated and upright supports shelving units in a manner eliminating a number of additional vertical supports that would typically have been used to support such an additional shelf. For example, FIG. 1 illustrates a prior art storage assembly 10 including a plurality of shelving units 12, more particularly, a first shelving unit 12*a*, a second shelving unit 12*b*, and a third shelving unit 12*c* positioned in an end-to-end relationship. Each shelving unit 12 includes four upright support rods 14 and at least one shelf 16 extending between the four upright support rods 14. Each shelf 16 includes a coupling sheath or coupling sleeve 18 at each corner thereof, which fits over a corresponding one of upright support rods 14.

As shown in FIG. 1, the end-to-end configuration of shelving units 12 results in a duplication of upright support rods 14 where first shelving unit 12 is adjacent second shelving unit 12*b* and again where second shelving unit 12*b* is adjacent third shelving unit 12*c*. Since each of first, second, and third shelving units 12*a*, 12*b*, and 12*c* are independently supported by their own independent, upright support rods 14, each of the shelving units 12 moves (e.g., may rock on an uneven support surface) independently of one another, such that stability of the overall storage assembly 10 is not promoted due to inclusion of more than one shelving unit 12. In addition, the side-by-side position of upright support rods 14 of the second shelving unit 12*b* with the upright support rods 14 of each of first and third shelving units 12*a* and 12*c* provides an impediment to accessing goods maintained on shelves 16 near such duplicate upright support rods 14.

Figure 2:
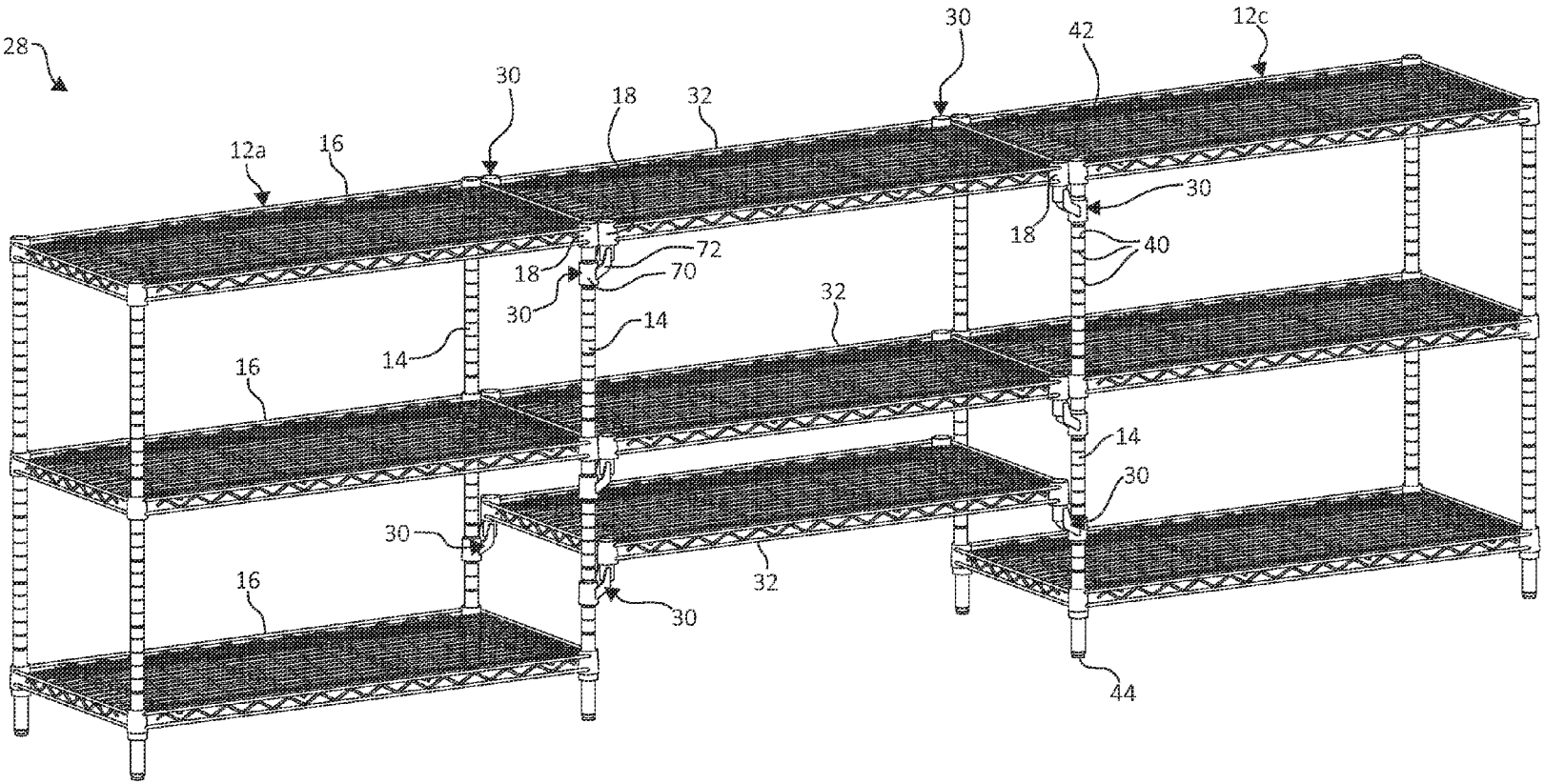
FIG. 2 is a front isometric view illustration of a shelving system, according to one embodiment of the present invention.

FIG. 2 shows a storage assembly 28 including shelving units 12*a* and 12*c*, a plurality of shelving connectors 30, and at least one additional or auxiliary shelf 32, according to the present invention. Each shelving unit 12*a* and 12*c* includes four elongated and upright support rods or legs 14 and at least one shelf 16 extending between the four upright support rods 14. In one example, upright support rods 14 are each substantially identical. Storage assembly 28 includes at least one additional or auxiliary shelf 32 extending between shelving units 12*a* and 12*c* without adding any additional upright support rods 14. For instance, in comparing storage assembly 10 (FIG. 1) to storage assembly 28, one will note that four upright support rods 14 have been eliminated while the same number of total shelves 16 or 32 is included by utilizing details of the present invention. In one example, auxiliary shelf 32 is substantially identical to shelves 16 of storage units 12*a* and 12*c*.

Figure 3:
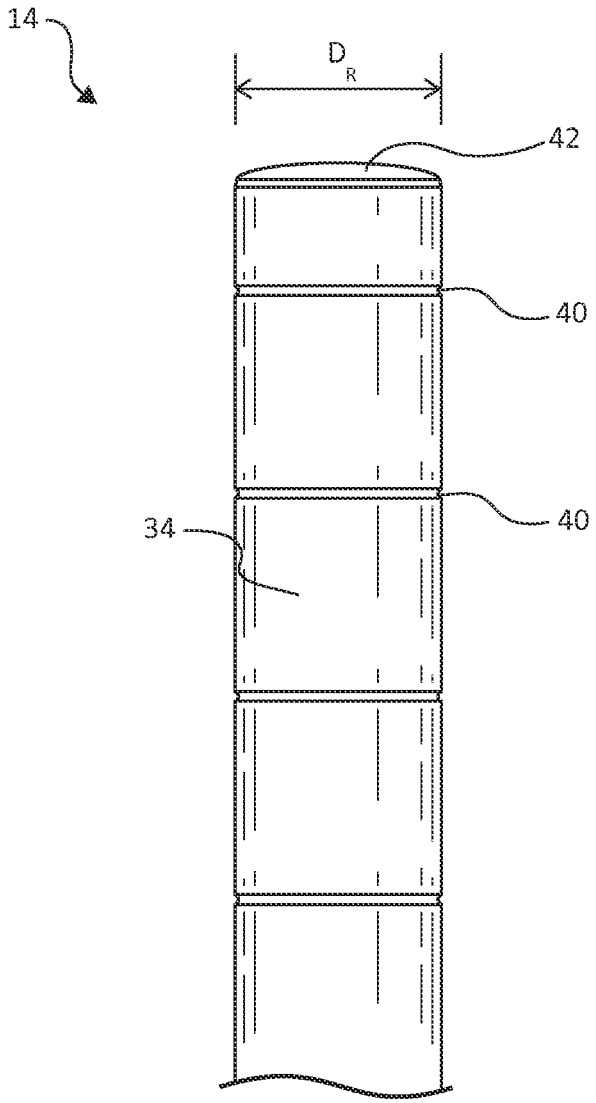
FIG. 3 is an enlarged front view illustration of an upright support rod of the shelving system of FIG. 2, according to one embodiment of the present invention.

In one embodiment, each upright support rod 14 is provided in the form of a cylinder, cuboid, triangular prism, or other suitable elongated shape. Additionally referring to the enlarged partial view of FIG. 3, in one example, each of the four upright support rods 14 is formed as a solid or hollow pipe or bar. Each upright support rod 14 defines an external surface 34 and includes a plurality of annular engagement grooves 40 extending radially inwardly from external surface 34. The plurality of annular engagement grooves 40 are arranged at longitudinal intervals, for example, consistently sized longitudinal intervals along each upright support rod 14. Each upright support rod 14 may additionally include a top cap 42, a bottom cap 44 or caster, as desired, e.g., as illustrated in FIGS. 2 and 3. In one example, each upright support rod 14 has an outside diameter of $D_R$. In one embodiment, each upright support rod 14 is primarily formed of a metal, such as steel, aluminum, or similar alloy, while top cap 42 is formed of plastic.

Figure 4:
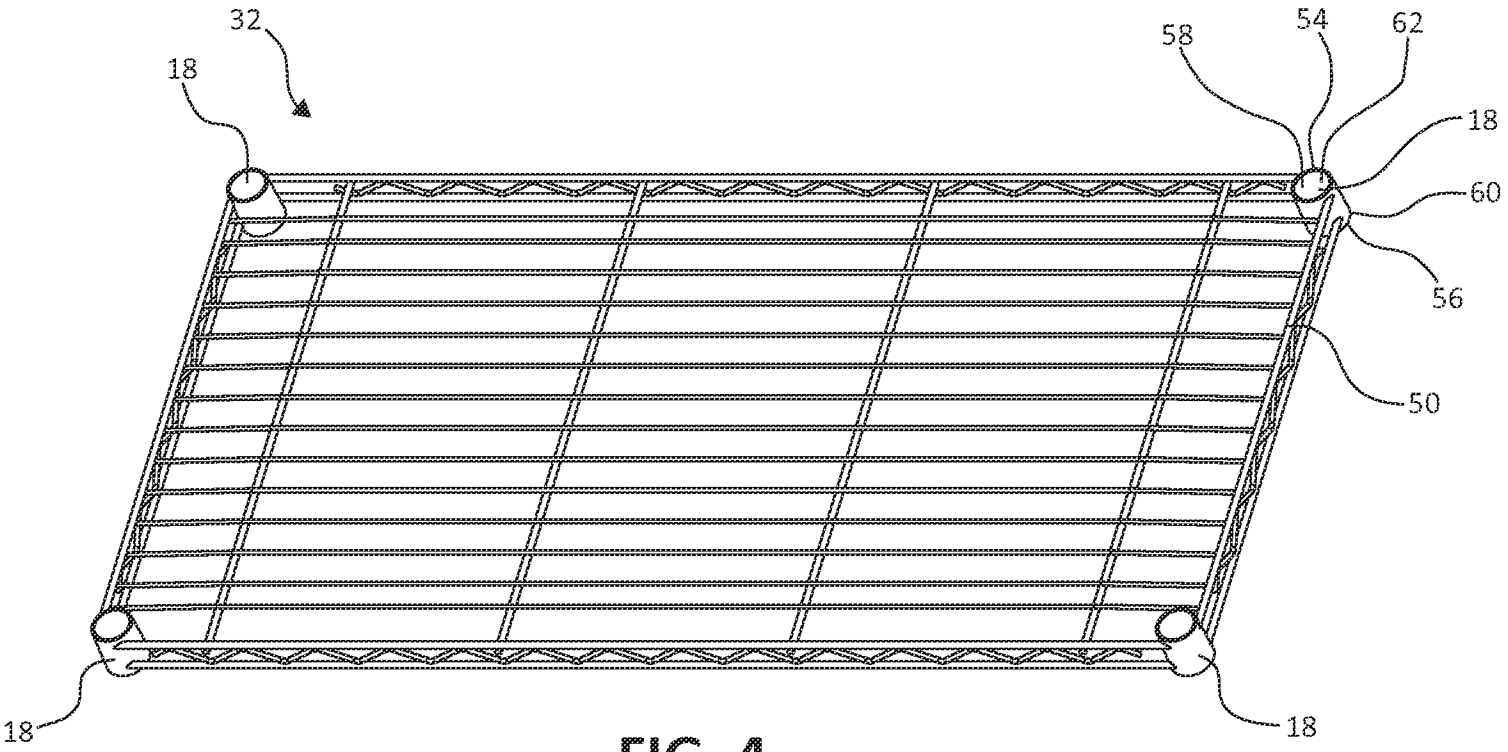
FIG. 4 is a top isometric view illustration of a shelf of the shelving system of FIG. 2, according to one embodiment of the present invention.
Figure 5:
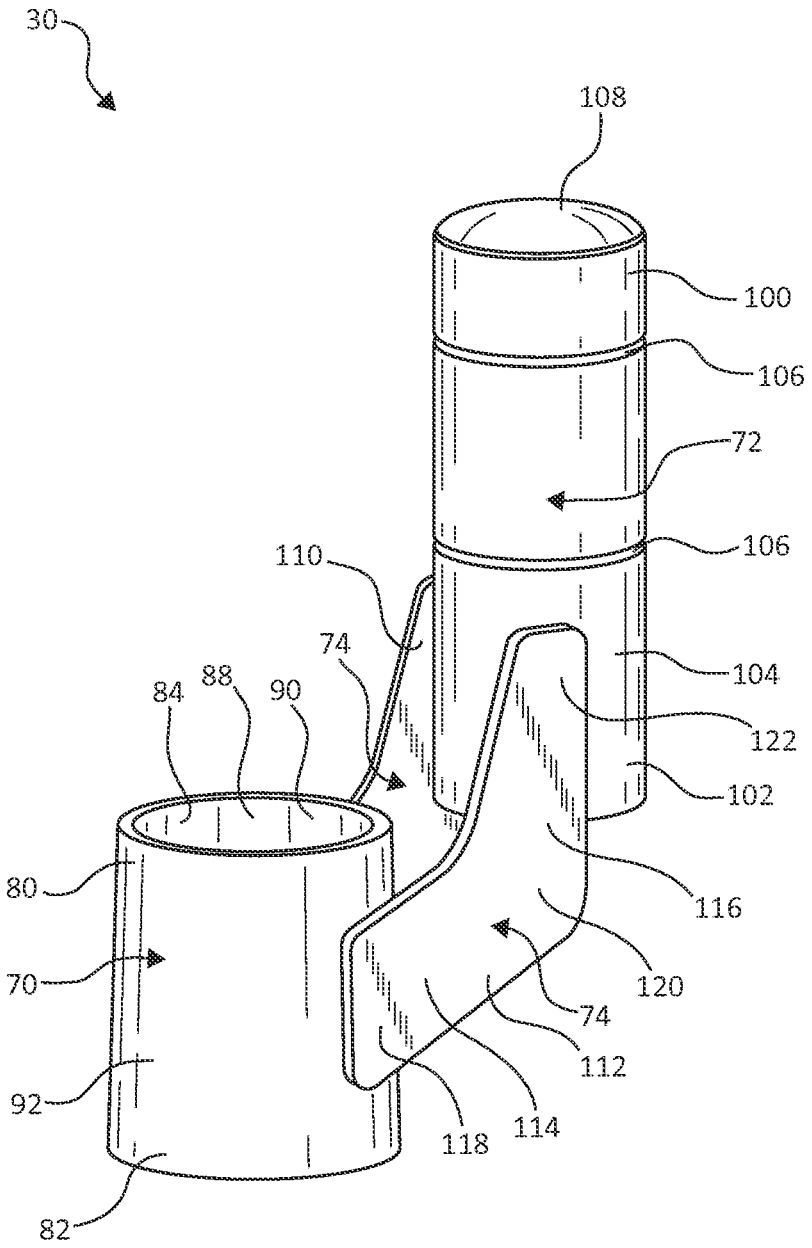
FIG. 5 is a front isometric view illustration of a shelving connector, according to one embodiment of the present invention.
Figure 6:
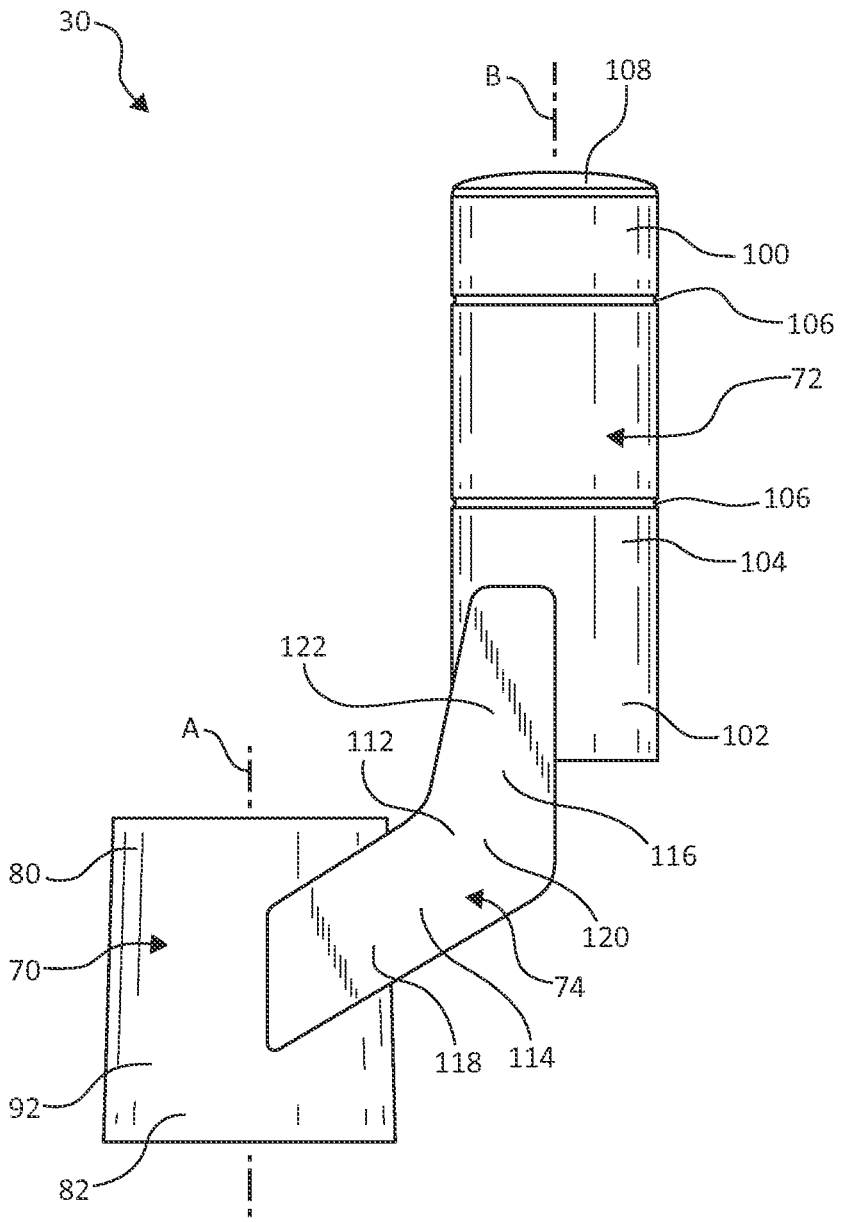
FIG. 6 is a front view illustration of the shelving connector of FIG. 5, according to one embodiment of the present invention. The rear view of the shelving connector is a mirror image of the front view, in one embodiment.
Figure 7:
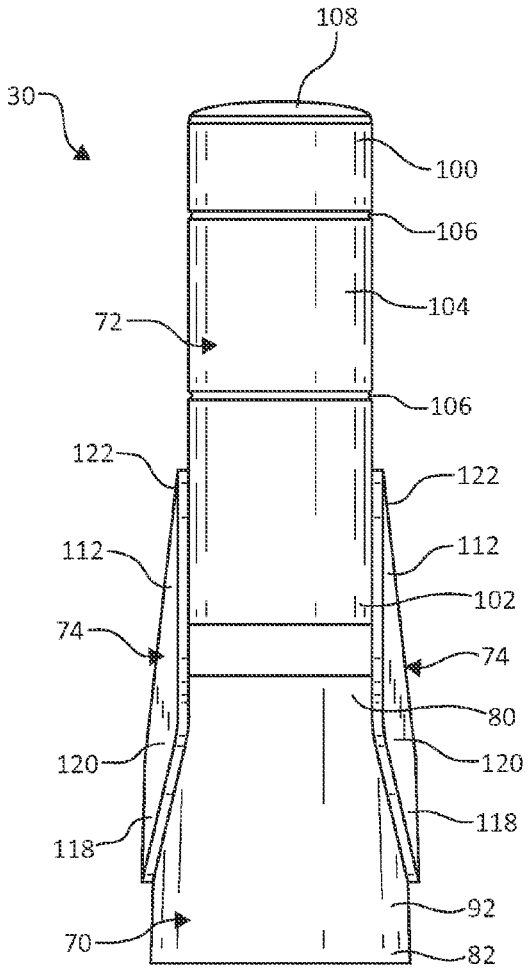
FIG. 7 is a right side view illustration of the shelving connector of FIG. 5, according to one embodiment of the present invention.
Figure 8:
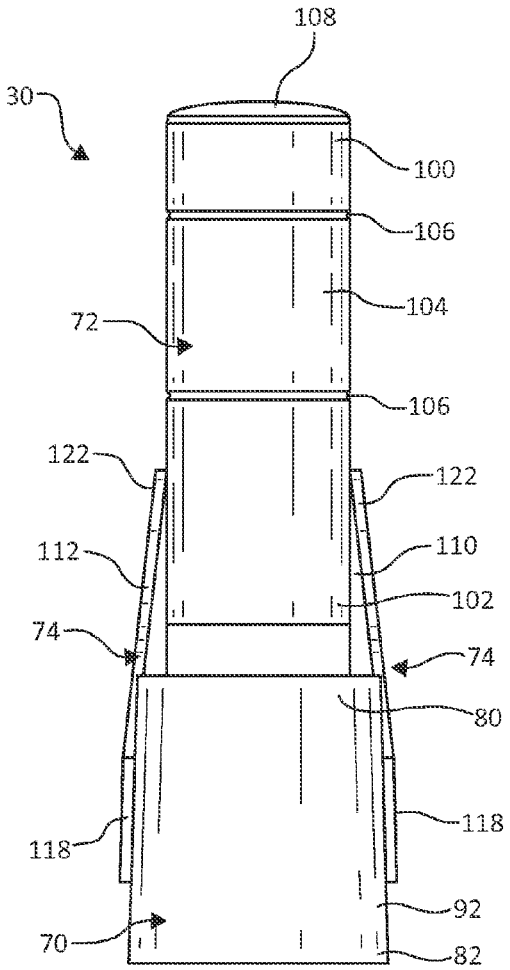
FIG. 8 is a left side view illustration of the shelving connector of FIG. 5, according to one embodiment of the present invention.
Figure 9:
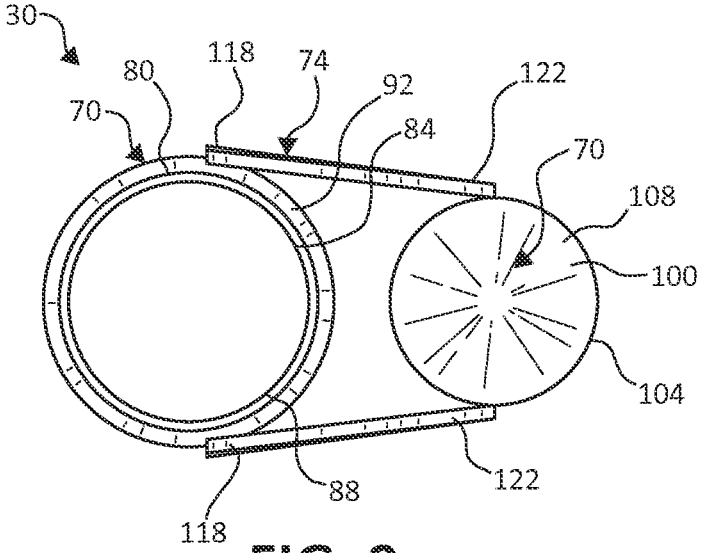
FIG. 9 is a top view illustration of the shelving connector of FIG. 5, according to one embodiment of the present invention.
Figure 10:
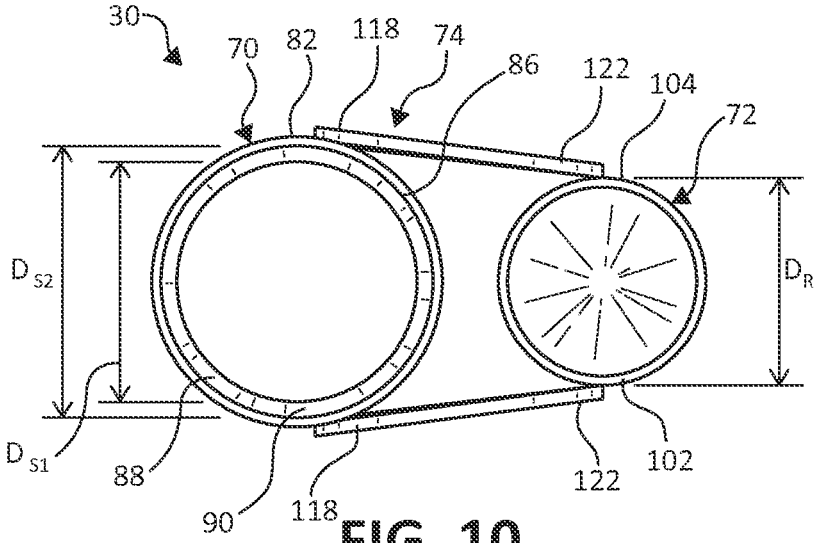
FIG. 10 is a bottom view illustration of the shelving connector of FIG. 5, according to one embodiment of the present invention.

Turning to FIG. 4, each auxiliary shelf 32 is formed to be generally rectangular, in one example, defining a top support surface 50 either as a continuous surface or as a discontinuous surface as shown in FIG. 4 for supporting goods to be stored on the corresponding one of shelving units 12 (see FIG. 2). At each corner of auxiliary shelf 32, auxiliary shelf 32 includes a coupling sleeve 18. Each coupling sleeve 18 is substantially hollow and frustoconical in shape extending between a top end 54 and a bottom end 56. Top end 54 includes a top opening 58 substantially centered therein, and bottom end 56 defines a bottom opening 60 (generally indicated in FIG. 4) substantially centered therein. Top opening 58 defines an inside diameter that is smaller than an inside diameter of bottom opening 60. Each coupling sleeve 18 defines a cavity 62 between top opening 58 and bottom opening 60. Top opening 58, bottom opening 60, and a cross section of cavity 62 are each of a shape substantially identical to a shape of one of upright support rods 14. In one example, the inside diameter of top end 54 is slightly larger than an outside diameter of a corresponding upright support rod 14. Each coupling sleeve 18 is configured to fit over a corresponding upright support rod 14 and, in one embodiment, is free to longitudinally slide along the corresponding upright support rod 14 unless an additional member is used to maintain a position of coupling sleeve 18 on upright support rod 14, as will be described further below.

FIGS. 5-10 illustrate one embodiment of shelving connector 30 in additional detail. Shelving connector 30 includes a coupling sleeve 70, an auxiliary support rod 72, and at least one bridge member 74. In one embodiment, coupling sleeve 70 is substantially identical to coupling sleeves 18 of shelves 32. Coupling sleeve 70 is a hollow frustoconical member defining a first or top sleeve end 80 and a second or bottom sleeve end 82 opposite top sleeve end 80. Top sleeve end 80 includes a top opening 84 substantially centered therein, and bottom sleeve end 82 defines a bottom opening 86 substantially centered therein. Top opening 84 defines a first inside sleeve diameter $D_{S1}$ (FIG. 10) that is smaller than a second inside sleeve diameter $D_{S2}$ (FIG. 10) of bottom opening 86. Coupling sleeve 70 defines a sleeve interior cavity 88 extending between top opening 58 and bottom opening 60. Coupling sleeve 70 defines an interior sleeve surface 90 adjacent sleeve interior cavity 88 and an opposite exterior sleeve surface 92. At top sleeve end 80, coupling sleeve 70 defines an internal diameter D1 that measures slightly larger than an outside diameter $D_R$ of one of upright support rods 14 and smaller than an internal diameter of coupling sleeve 70 at bottom sleeve end 82.

Auxiliary support rod 72 is formed as a solid or hollow pipe or bar, for instance a cylindrical pipe or bar extending between a top rod end 100 and a bottom rod end 102 and having an exterior rod surface 104. Auxiliary support rod 72 includes a plurality of annular engagement grooves 106 extending radially inwardly from exterior rod surface 104. The plurality of annular engagement grooves 106 are arranged at longitudinal intervals, for example, consistently sized longitudinal intervals along each auxiliary support rod 72. In one example, a distance between adjacent ones of annular engagement grooves 106 on auxiliary support rod 72 is substantially identical to a distance between adjacent ones of annular engagement grooves 40 on upright support rods 14 (see, e.g., FIG. 3). Each auxiliary support rod 72 may additionally include a top cap 108.

In one example, each auxiliary support rod 72 has an outside diameter of $D_R$, that is, substantially identical to outside diameter $D_R$ of upright support rods 14. In one embodiment, each auxiliary support rod 72 is primarily formed of a metal, such as steel, aluminum, or similar alloy, while top cap 98 is formed of plastic. In one example, auxiliary support rod 72 is substantially identical to one of upright support rods 14 other than being significantly shorter in length than any one of upright support rods 14. In one embodiment, auxiliary support rod 72 includes at least two annular engagement grooves 106.

Bridge member 74 is statically positions coupling sleeve 70 relative to auxiliary support rod 72 and, in one example, couples coupling sleeve 70 to auxiliary support rod 72. In one example, bridge member 74 is substantially planar and formed of a suitably rigid material such as a metal or other plate. Bridge member 74 defines an interior surface 110 and an exterior surface 112 opposite interior surface 110. In one example, bridge member 74 has a substantially L-shaped configuration defining a first segment 114 and a second segment 116. More specifically, in one example, first segment 114 extends from a first end 118 of bridge member 74 to an intersection 120 with second segment 116, and second segment 116 extends from intersection 120 to a second end 122 of bridge member 74. In one embodiment, each of first and second segments 114 and 116 are substantially linear with first segment 114 is angled between about 120 degrees to about 150 degrees from second segment 116. In one example, shelving connector 30 includes two substantially identical bridge members 74. While primarily described above as being substantially L-shaped, bridge member 74 may be any one of a plurality of shapes, such as, rectangular, circular, triangular, elliptical, etc.

During assembly of shelving connector 30, one or more bridge members 74 are used to couple coupling sleeve 70 to auxiliary support rod 72 such that respective centerlines A and B (see FIG. 6) of each coupling sleeve 70 and auxiliary support rod 72 are orientated to extend substantially parallel to one another. More specifically, in one example, interior surface 110 of bridge member 74 is placed immediately adjacent exterior sleeve surface 92 of coupling sleeve 70 at first end 118 of bridge member 74 and immediately adjacent exterior rod surface 104 of auxiliary support rod 72 at second end 122 of bridge member 74. Once so positioned, bridge member 74 is statically coupled to each of exterior sleeve surface 92 of coupling sleeve 70 and exterior rod surface 104 of auxiliary support rod 72 in any suitable manner such as via welding, adhesive, coupling mechanisms (rivets, screws, pegs), etc.

As illustrated, bridge member 74 is positioned relative to each of coupling sleeve 70 and auxiliary support rod 72 such that top rod end 100 of auxiliary support rod 72 extends above top sleeve end 80 of coupling sleeve 70 a distance greater than a distance between two of the annular engagement grooves 40 on upright support rods 14 and/or, in one example, a distance greater than a height of a coupling sleeve 18 of one of shelves 16 or 32. In one example, auxiliary support rod 72 has a sufficient length above second end 122 of bridge member 74 to receive at least one coupling sleeve 18 of one of shelves 16 or 32. As illustrated, bottom rod end 102 of auxiliary support rod 72 is positioned to extend entirely above top sleeve end 80 of coupling sleeve 70.

Figure 11:
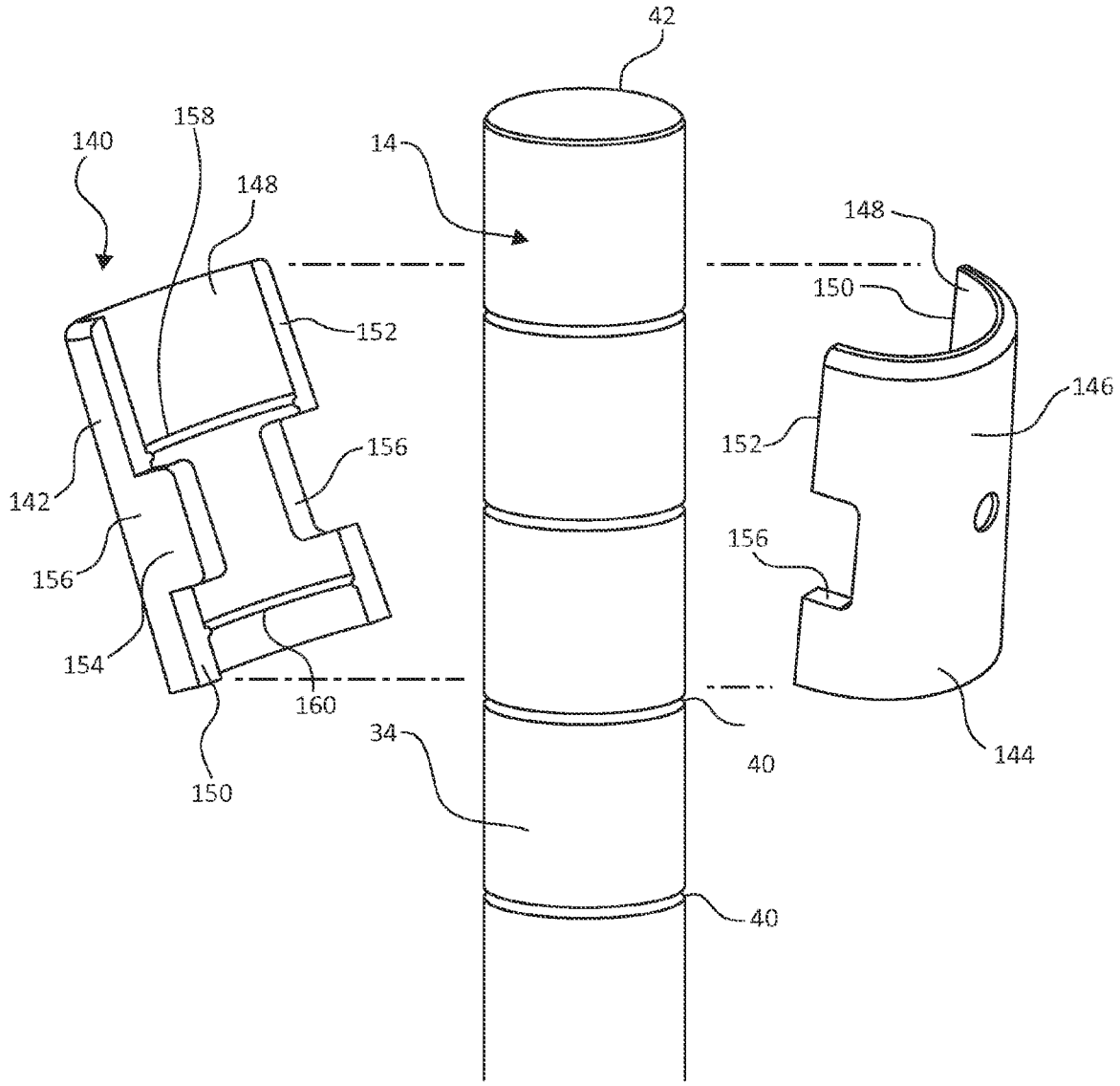
FIG. 11 is an exploded, front isometric view of an upright support rod and a locator cuff of the shelving system of FIG. 2, according to one embodiment of the present invention.
Figure 12:
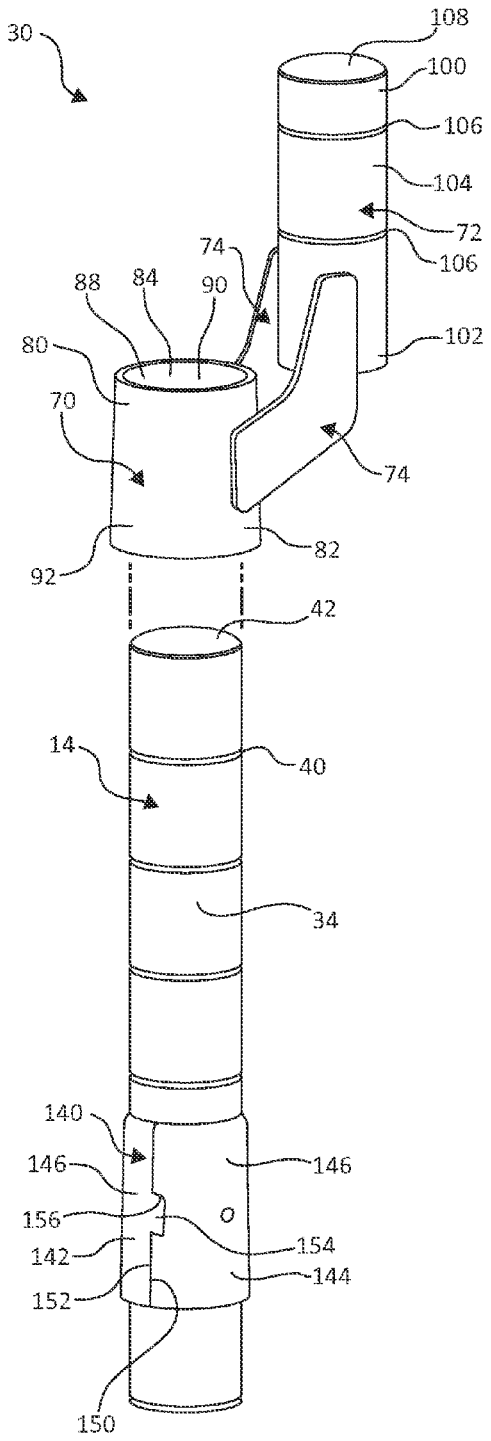
FIG. 12 is a partially exploded, front isometric view of the upright support rod and the locator cuff of FIG. 11 with the shelving connector of FIG. 5, according to one embodiment of the present invention.
Figure 13:
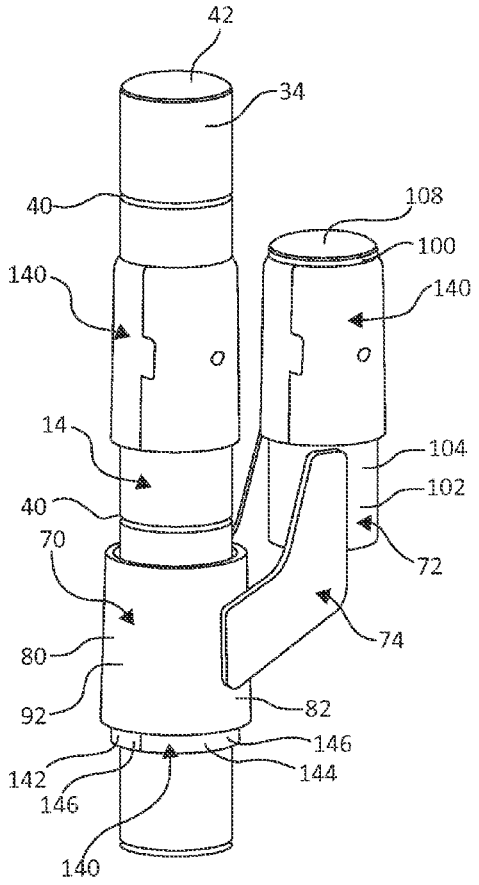
FIG. 13 is a front isometric view of the upright support rod, the locator cuff, and the shelving connector of FIG. 12 with an additional locator cuff, according to one embodiment of the present invention.

During use of shelving connector 30 with shelves 32, each shelving connector 30 is configured to be coupled with one of upright support rods 14 and to receive a coupling sleeve 18 of a corresponding auxiliary shelf 32 using a locator cuff 140 as illustrated, for example, in FIGS. 11-13. Locator cuff 140 includes two pieces, a first cuff piece 142 and a second cuff piece 144, each formed in a semi-frustoconical manner and configured to snap together to collectively form exterior surface 146 of locator cuff 140 in a frustoconical shape. More specifically, as illustrated, first cuff piece 142 is substantially identical to second cuff piece 144, and each of first and second cuff pieces 142 and 144 defines an exterior surface 146 and an interior surface 148, which is opposite the exterior surface 146. First cuff piece 142 curvilinearly extends between a first longitudinal edge 150 and a second longitudinal edge 152 such that exterior surface 146 is convex and interior surface 148 is concave.

In one example, first longitudinal edge 150 defines an engagement projection 154 in a center portion thereof relative to corresponding top and bottom ends of first cuff piece 142. Engagement projection 154 circumferentially extends further from second longitudinal edge 152 than a remainder of first longitudinal edge 150. Second longitudinal edge 152 of first cuff piece 142 defines an engagement recess 156 for selectively receiving a corresponding engagement projection 154 of second cuff piece 144. Each engagement recess 156 is vertically or longitudinally shaped substantially identically to engagement projection 154 and is longitudinally positioned along second longitudinal edge 152 in a position corresponding with the longitudinal position of engagement projection 154 along first longitudinal edge 152. Second cuff piece 144 includes first and second longitudinal edges 150 and 152, engagement projection 154, and engagement recess 156 in a substantially identical manner as described above for first cuff piece 142. In this manner, first and second cuff pieces 142 and 144 are configured to be selectively coupled to one another by mating engagement projection 154 of one of first and second cuff pieces 142 and 144 with engagement recess 156 of the other of first and second cuff pieces 142 and 144.

Each of first and second cuff pieces 142 and 144 includes longitudinally spaced top and bottom semi-annular ribs 158 and 160 extending along a corresponding interior surface 148 thereof. Each of top and bottom semi-annular ribs 158 and 160 is sized and shaped and spaced from the other of the top and bottom semi-annular rib 158 or 160 to be snugly received within a different one of two corresponding ones of annular engagement grooves 40 or 106 of one of upright support rods 14 or auxiliary support rod 72. Top and bottom semi-annular ribs 158 and 160 of first cuff piece 142 longitudinally align with top and bottom semi-annular ribs 158 and 160 of second cuff piece 144 such that they collectively define top and bottom annular ribs when first cuff piece 142 is coupled with second cuff piece 144.

During assembly of storage assembly 28, one locator cuff 140 is placed around one of upright support rods 14, as illustrated in FIGS. 11-13, in a longitudinal position corresponding with a desired shelf height. More specifically, first cuff piece 142 is placed on one side of upright support rod 14, and second cuff piece 144 is placed on the opposing side of upright support rod 14. First and second cuff pieces 142 and 144 are pushed toward each other and are coupled to one another via frictional interaction between engagement projections 154 of each of first and second cuff pieces 142 and 144 with corresponding engagement recesses 156 of the other of first and second cuff pieces 142 and 144. More specifically, in one example, first longitudinal edge 150 of first cuff piece 142 is positioned immediately adjacent second longitudinal edge 152 of second cuff piece 144 such that engagement projection 154 of first cuff piece 142 is snugly received by engagement recess 156 of second cuff piece 144. Similarly, first longitudinal edge 150 of second cuff piece 144 is positioned immediately adjacent second longitudinal edge 152 of first cuff piece 142 such that engagement projection 154 of second cuff piece 144 is snugly received by engagement recess 156 of first cuff piece 142.

When so coupled, interior surfaces 148 of locator cuff 140 defines a cylindrical interior cavity (not shown) with a diameter substantially equal to or slightly greater than outer diameter $D_R$ of upright support rod 14. In one example, the cylindrical interior cavity has a consistent inside diameter along its length. In this manner, locator cuff 140 encircles upright support rod 14. When so formed, top and bottom semi-annular ribs 158 and 160 of first cuff piece 142 fits within a different one, for example, adjacent ones, of annular engagement grooves 40, and top and bottom semi-annular ribs 158 and 160 of second cuff piece 144 fit within the same different ones of annular engagement grooves 40 as top and bottom semi-annular ribs 158 and 160 of first cuff piece 142. Semi-annular rib 158 and 160 mate with annular engagement grooves 40 to maintain locator cuff 140 in a selected longitudinal position along upright support rod 14. When first and second cuff pieces 142 and 144 are coupled together, first and second cuff pieces 142 and 144 collectively define exterior surface 146 of locator cuff 140 in a frustoconical shape having a top diameter that is less than less than second inside sleeve diameter $D_{S2}$ but greater than first inside diameter $D_{S1}$ of coupling sleeve 70.

Coupling sleeve 70 of shelving connector 30 is slid down and around upright support rod 14 and locator cuff 140 as illustrated with reference to FIG. 12 and the subsequent positioning of FIG. 13. An inside surface of sleeve interior cavity 88 defined by coupling sleeve 70 frictionally engages locator cuff 140, which is already selectively secured to upright support rod 14. Due to the frustoconical shape of each of locator cuff 140 and sleeve interior cavity 88, as shelving connector 30 is slid further down on locator cuff 140, coupling sleeve 70 fits tighter and tighter around locator cuff 140. A bottom diameter of locator cuff 140 is greater than second inside sleeve diameter $D_{S2}$ such that movement of coupling sleeve 70 is generally stopped before coupling sleeve 70 reaches a bottom end of locator cuff 140 and shelving connector 70 is statically secured to upright support rod 14 via gravitational and frictional forces as shown in FIG. 13.

Additional locator cuffs 140 maybe be placed above and below the above-described locator cuff 140 to receive other sleeves 18 of shelves 32 and/or other sleeves 70 of additional shelving connectors 30. In general, storage assembly 28 is built on an upright support rod 14 from the bottom up with a bottommost locator cuff 140 being positioned first, followed by a corresponding auxiliary shelf 32 or shelving connector 30 optionally followed by another locator cuff 140 and a corresponding auxiliary shelf 32 or shelving connector 30 and so forth as desired to achieve a desired configuration of storage assembly 28. The process is repeated for each upright support rod 14 as will be apparent to those of skill in the art upon reading this application.

Figure 14:
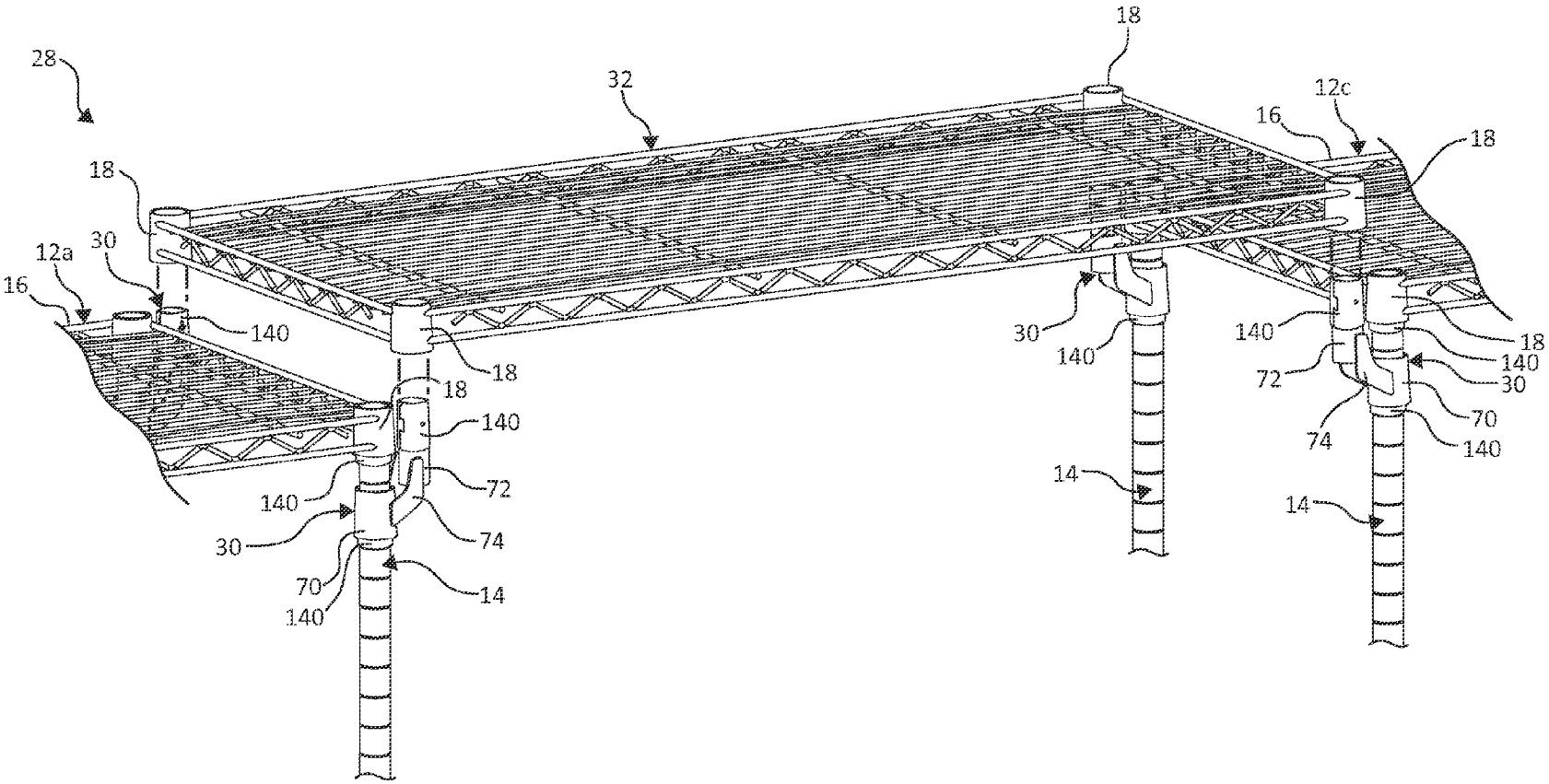
FIG. 14 is a partially exploded view of a portion of the shelving system of FIG. 2 during assembly, according to one embodiment of the present invention.
Figure 15:
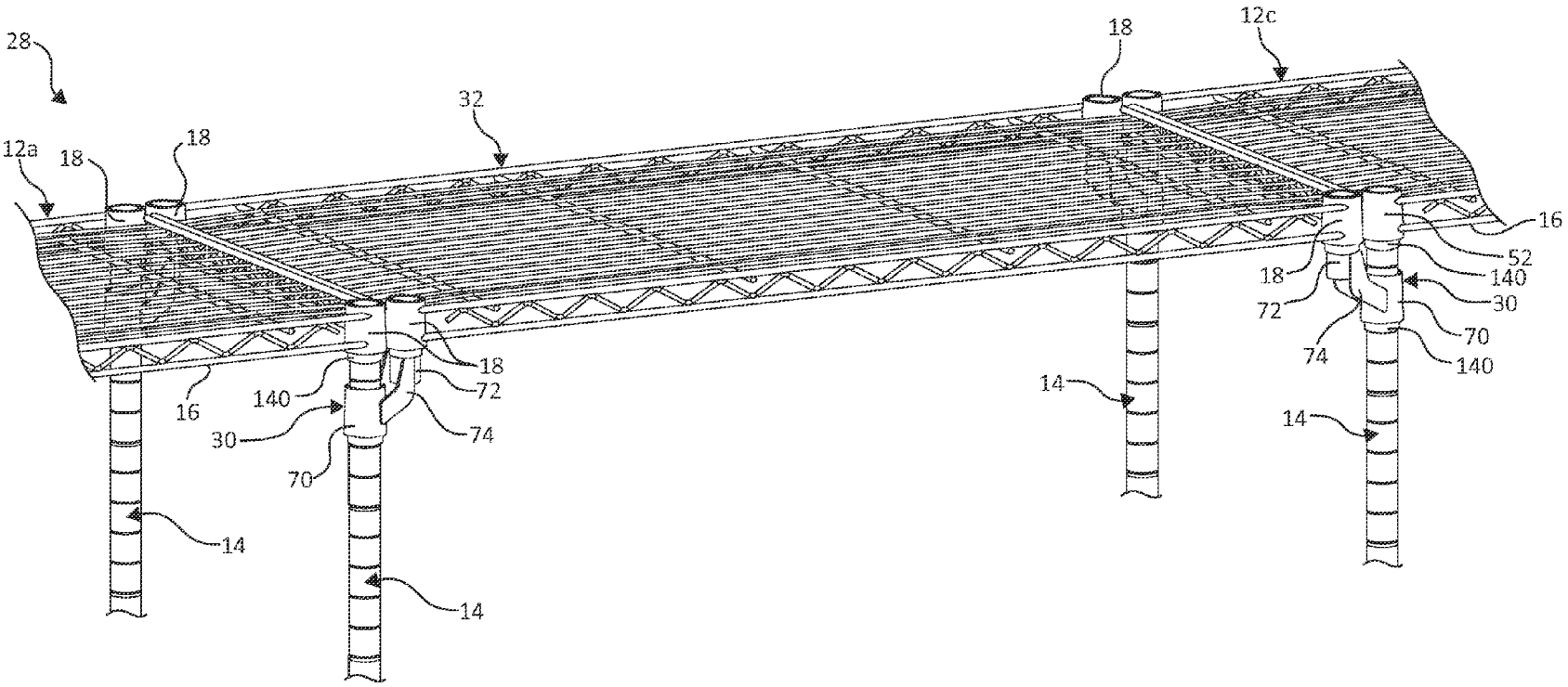
FIG. 15 is a front isometric view illustration of an enlarged portion of the shelving system of FIG. 2, according to one embodiment of the present invention.

Once shelving units 12*a* and 12*c* are assembled with shelving connectors 30 on adjacent upright support rods 14, sleeves 18 of auxiliary shelves 32 are moved downwardly onto corresponding ones of shelving connectors 30 already coupled to upright vertical support rods 14. For example, sleeves 18 of one auxiliary shelf 32 are slid onto shelving connectors 30 that are each coupled with one of two upright vertical support rods 14 of each of shelving units 12*a* and 12*c*, that is four total upright vertical support rods 14, as illustrated in FIGS. 14 and 15. More specifically, one locator cuff 140 is secured to each auxiliary support rod 72 of the four shelving connectors 70 as shown in FIGS. 13 and 14. Locator cuffs 140 are secured to corresponding support rods 72 in the same manner locator cuffs 140 are secured directly to upright support rods 14. That is, first and second cuff pieces 142 and 144 of a locator cuff 140 are coupled to one another around auxiliary support rod 72 such that top and bottom semi-annular ribs 158 and 160 (FIG. 11) of first and second cuff pieces 142 and 144 are snugly nested in the corresponding annular engagement grooves 106 of auxiliary support rod 72. Turning to FIG. 14, sleeves 18 of auxiliary shelf 32 are each placed over a different locator cuff 140 that is on a different auxiliary support rod 72 of a shelving connector 30 to secure auxiliary shelf 32 to upright support rods 14 in a manner extending between shelving units 12*a* and 12*c*.

Due to the vertical offset of coupling sleeve 70 and auxiliary support rod 72 of shelving connector 30, one or more auxiliary shelves 32 may be placed in a common vertical height with shelves 16 of shelving units 12*a* and 12*c* as shown in FIGS. 2, 14, and 15 for the two auxiliary shelves 32 of storage assembly 28. In this manner, a substantially continuous storage surface is defined over one of shelves 16 of shelving unit 12*a*, a corresponding auxiliary shelf 32, and/or a corresponding shelf 16 of shelving unit 12*c*. In one embodiment, the lateral spacing between coupling sleeve 70 and auxiliary support rod 72 of shelving connector 30 is sized such that resultant a shelf 16 on storage unit 12*a* or 12*c* positioned at a similar height as an auxiliary shelf 32 nearly or actually abuts an adjacent end of such auxiliary shelf such that no large gaps are formed between shelf 16 and auxiliary shelf 32. Alternatively or additionally, one or more auxiliary shelf 32 may be positioned at a vertical offset with other shelves of shelving units 12*a* and 12*c* as shown for the bottom auxiliary shelf 32 in FIG. 2.

As described herein, shelving connector 30 allows for flexibility in forming a storage assembly 28 without requiring additional upright support rods 14 and in a manner securing shelving units 12*a* and 12*c* to one another, that is via shelving connectors 30 and one or more auxiliary shelves 32, to create storage assembly 28 in a more stable and unitary manner. Elimination of additional upright support rods 14 not only reduces material needed for storage assembly 28, but also eliminates obstacles to storing, viewing, and/or reaching products stored on storage assembly 28. While primarily illustrated as being used in a linear storage system configuration, the frustoconical shape of sleeves 70 of shelving connectors 30 allows shelving connectors 70 to be rotated to any desired position such that a shelving unit 12 may be coupled to auxiliary shelves extending at a non-linear angle relative to shelves 16 of shelving unit 12 as will be apparent to those of skill in the art upon reading this application. Accordingly, shelving connectors 30 provide storage assembly 28 in a more stable and more customizable manner than prior systems while using fewer upright support rods 14.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A combination including:

a shelving connector for coupling an auxiliary shelf within a shelving system, the shelving connector comprising:

a coupling sleeve defining and extending between a first sleeve end and a second sleeve end and defining a sleeve exterior surface and a sleeve interior cavity, the sleeve interior cavity being open at each of the first sleeve end and the second sleeve end, a support rod defining a rod exterior surface, wherein a center axis of the coupling sleeve and a center axis of the support rod are positioned to extend substantially parallel to each other, and a bridge member secured to the sleeve exterior surface and the rod exterior surface to statically hold the support rod in a position laterally spaced from and vertically offset from the coupling sleeve; and a locator cuff selectively couplable with the support rod and having an interior cuff surface defining an interior cuff diameter, wherein the interior cuff diameter is substantially equal to an exterior diameter of the support rod, and an outside cuff surface that is frustoconical in shape.

2. The combination of claim 1, wherein the rod exterior surface includes at least one annular engagement groove extending inwardly from the exterior surface of the support rod.

3. The combination of claim 1, wherein the support rod is positioned entirely on a first side of the first sleeve end with the first side being opposite the second sleeve end as relative to the first sleeve end.

4. The combination of claim 1, wherein the coupling sleeve is frustoconical in shape such that the first sleeve end has a smaller diameter than the second sleeve end.

5. The combination of claim 4, wherein:

the support rod is cylindrical, a smallest inside diameter of the sleeve interior cavity is greater than an exterior diameter of the support rod defined by the rod exterior surface.

6. The combination of claim 1, wherein:

the bridge member is a first one of two bridge members, each of the two bridge members is a substantially planar plate, opposite ends of the first one of the two bridge members are each coupled to a first side of a different one of the support rod and the coupling sleeve, and opposite ends of the second one of the two bridge members are each coupled to a second side of the different ones of the support rod and the coupling sleeve opposite the first side.

7. The combination of claim 1, wherein the outside cuff surface has a bottommost diameter that is larger than a bottommost diameter of the sleeve interior cavity.

8. The combination of claim 1, wherein:

the locator cuff defines an interior cuff surface and includes an annular rib extending inwardly from the interior cuff surface, and the annular rib is sized to be at least partially received within the at least one annular engagement groove of the support rod to maintain a vertical position of the locator cuff relative to the support rod.

9. The combination of claim 8, wherein the locator cuff is formed of two semi-frustoconical cuff members frictionally couplable with one another around the support rod.

10. The combination of claim 1, wherein the locator cuff is a first one of two substantially identical locator cuffs, and the combination includes a second one of the two substantially identical locator cuffs is maintained within the coupling sleeve.

11. The combination of claim 10, in further combination with a support leg of a shelving unit and the auxiliary shelf, wherein:

the support leg has a cross-sectional shape substantially identical to a cross-sectional shape of the support rod, the second one of the two substantially identical locator cuffs is secured around the support leg, the coupling sleeve is coupled to the support leg via the second one of the two substantially identical locator cuffs, and the auxiliary shelf includes a corner sheath, which is frictionally secured about the support rod via the first one of the two substantially identical locator cuffs such that the auxiliary shelf is supported at the corner sheath in a position offset from the coupling sleeve via shelving connector.

12. A shelving system comprising:

an upright support leg;

a shelving connector including:

a coupling sleeve defining a sleeve exterior surface, a sleeve interior cavity, and a sleeve center axis, the sleeve interior cavity being open at each of a first sleeve end and a second sleeve end opposite the first sleeve end, wherein the upright support leg extends through the coupling sleeve, a support rod having a support rod center axis positioned substantially parallel to the sleeve center axis, and a bridge member securing the coupling sleeve to the support rod such that the support rod is laterally spaced from and vertically offset from the coupling sleeve; and a shelf including a coupling sheath, the coupling sheath being secured around the support rod to maintain the shelf laterally offset from the upright support leg;

wherein:

the shelf is a first shelf, the shelving system further comprises:

a second shelf including a second shelf coupling sheath, and a third locator cuff substantially identical to the two substantially identical locator cuffs and positioned around the upright support leg above the first one of the two substantially identical locator cuffs, and the third locator cuff interacts with the second shelf coupling sheath to couple the second shelf to the upright support leg at a position vertically aligned with the first shelf.

13. The shelving system of claim 12, further comprising two substantially identical locator cuffs each defining a frustoconical exterior surface, wherein:

the first of the two substantially identical locator cuffs is secured about the upright support leg, the coupling sleeve extends around and interacts directly with the first of the two substantially identical locator cuffs to secure the coupling sleeve to the upright support leg, the second one of the two substantially identical locator cuffs is secured about the support rod of the shelving connector, and the coupling sheath of the shelf extends around and interacts directly with the second of the two substantially identical locator cuffs to secure the coupling sheath to the support rod of the shelving connector.

14. The shelving system of claim 12, wherein:

the coupling sleeve is frustoconical in shape having a smaller diameter at a top sleeve end than at a bottom sleeve end opposite the top sleeve end, frictional interaction between the first one of the two substantially identical locator cuffs and the coupling sleeve increases as the coupling sleeve is slide downwardly relative to the support leg to couple the coupling sleeve with the upright support leg.

15. The shelving system of claim 12, wherein:

the first shelf and the second shelf are substantially identical, the coupling sheath is located in a corner of the first shelf, the second shelf coupling sheath is located in a corner of the second shelf, and the first shelf and the second shelf are positioned such that the corner of the first shelf is positioned adjacent the corner of the second shelf.

16. A method of coupling a shelf to an upright support leg, the method comprising:

sliding a coupling sleeve of a shelving connector about the upright support leg, wherein the shelving connector includes:

the coupling sleeve, a support rod extending substantially parallel to and being laterally offset from the coupling sleeve, and a bridge member maintaining the position of the coupling sleeve relative to the support rod;

sliding a corner sheath of a first shelf over the support rod such that the shelf is supported by and laterally offset from the upright support leg; and sliding a corner sheath of a second shelf over the upright support leg and positioning the corner sheath of the second shelf in a position vertically offset from the coupling sleeve and vertically aligned with the first shelf.

17. The method of claim 16, further comprising:

coupling a first locator cuff about the upright support leg prior to sliding the coupling sleeve about the upright support leg, wherein sliding the coupling sleeve about the upright support leg includes sliding the coupling sleeve over the first locator cuff to secure the coupling sleeve to the upright support leg; and coupling a second locator cuff about the support rod prior to sliding the corner sheath of the first shelf over the support rod, wherein sliding the corner sheath over the support rod includes sliding the coupling sheath over the second locator cuff to secure the first shelf to the support rod via the second locator cuff.

* * * * *